US007064601B2

(12) United States Patent
Kwak et al.

(10) Patent No.: US 7,064,601 B2
(45) Date of Patent: Jun. 20, 2006

(54) REFERENCE VOLTAGE GENERATING CIRCUIT USING ACTIVE RESISTANCE DEVICE

(75) Inventors: Choong-Keun Kwak, Suwon (KR); Du-Eung Kim, Suwon (KR); Woo-Yeong Cho, Suwon (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 659 days.

(21) Appl. No.: 09/955,458

(22) Filed: Sep. 18, 2001

(65) Prior Publication Data

US 2002/0039044 A1 Apr. 4, 2002

(30) Foreign Application Priority Data

Sep. 30, 2000 (KR) ..... 2000-57570

(51) Int. Cl.
*G05F 1/46* (2006.01)

(52) U.S. Cl. ..... 327/541; 327/543; 323/315

(58) Field of Classification Search ..... 327/540, 327/541, 543, 545, 546; 323/313–315
See application file for complete search history.

(56) References Cited

U.S. PATENT DOCUMENTS 4,868,482 A * 9/1989 O'Shaughnessy et al. .. 323/313
5,378,936 A * 1/1995 Kokubo et al. ..... 327/77
5,530,397 A 6/1996 Nakai et al. ..... 327/545
5,565,811 A 10/1996 Park et al. ..... 327/546
5,838,188 A * 11/1998 Taguchi ..... 327/530
5,841,270 A 11/1998 Do et al. ..... 323/314
5,877,652 A * 3/1999 Oh ..... 327/546
5,880,625 A * 3/1999 Park et al. ..... 327/543
5,892,388 A * 4/1999 Chiu ..... 327/543
6,104,234 A * 8/2000 Shin et al. ..... 327/535
6,362,655 B1 * 3/2002 Abraham et al. ..... 326/83
6,388,507 B1 * 5/2002 Hwang et al. ..... 327/538
6,586,919 B1 * 7/2003 Viehmann ..... 323/315

OTHER PUBLICATIONS

Viehmann, PCT/DE01/00333, WO 01/61430 A1, "Voltage Current Transformer", Aug. 23, 2001.*

* cited by examiner

*Primary Examiner*—Timothy P. Callahan
*Assistant Examiner*—Terry L. Englund
(74) *Attorney, Agent, or Firm*—F.Chau & Associates, LLC

(57) ABSTRACT

A reference voltage generating circuit includes a current mirror circuit having first and second current paths formed between a first power source terminal and a second power source terminal in which the current mirror circuit is operated in response to a voltage level of the second current path, a reference voltage output node for providing a reference voltage and being located on the second current path, an active resistance device formed on the first current path to be operated in a linear region of a current-voltage characteristic curve of the active resistance device, and a voltage supply circuit for supplying the active resistance device with an enable voltage to control the active resistance device to be operated in the linear region.

13 Claims, 6 Drawing Sheets

REFERENCE VOLTAGE GENERATING CIRCUIT USING ACTIVE RESISTANCE DEVICE

BACKGROUND OF THE INVENTION

1. Field of the Invention

The present invention relates to a reference voltage generating circuit, and more particularly, to a reference voltage generating circuit employing active resistance devices to secure operational reliability of the circuit and to reduce a layout area thereof.

2. Description of the Related Arts

As semiconductor devices are fabricated with more precise manufacturing processes, the thickness of insulating layers (e.g., $SiO_2$, $Si_3N_4$, etc.) in metal oxide semiconductor (MOS) devices becomes more thin. The thinner the layer, the more it is prone to dielectric breakdown caused by the power supply voltage. For more reliable operation, a fixed internal power voltage is needed independent of a variable external power voltage.

Reference voltage generating circuits generally employ semiconductor material layers, such as an intrinsic poly-silicon layer, an $N^+/P^+$ active layer, an $N^-/P^-$ well layer, etc., as passive resistance devices. While resistance values of the resistance devices may be readily controlled using the intrinsic poly-silicon, it is an additional process to create an intrinsic poly-silicon layer.

The $N^+/P^+$ active layer used for a resistance device has disadvantages such that it is difficult to control a resistance value in the source/drain region of a MOS device, and it is also difficult to obtain a high resistance value due to heavy doping.

A resistance device using the $N^-/P^-$ well layer may have a high resistance value. However, since the resistance value varies in a large range, it is difficult to control the resistance and to get a reliable resistance value and a layout area of the resistance device should be increased to get a suitable resistance value.

Conventional reference voltage generating circuits using passive resistance devices will be explained with reference to FIG. 1 and FIG. 2.

FIG. 1 illustrates a conventional threshold voltage type reference voltage generating circuit using a passive resistance device. In the reference voltage generating circuit, a resistor R and MOS transistors Q1, Q2, and Q3 are arranged to maintain a constant voltage near the threshold voltage of the MOS transistors and to obtain a temperature compensation effect. A resistor R1 is required to generate a reference voltage as shown in FIG. 1, and a high resistance should be used to minimize the current consumption of the circuit.

For example, if an external voltage EVcc is 5V, an internal reference voltage Vref is 2V, and the current consumption is limited to 1 μA, the resistance value of the resistor R1 is:

$$R1=(5V-2V)/1\ \mu A=3\ M\Omega.$$

In case that the resistor R1 is a passive resistance device such as an intrinsic poly-Si layer, an $N^+/P^+$ active layer, an $N^-/P^-$ well layer, etc., the same problems as mentioned above occur in the reference voltage generating circuit in FIG. 1.

FIG. 2 illustrates a conventional current mirror type reference voltage generating circuit having a passive resistance device. The circuit includes PMOS transistors Q4 and Q5, NMOS transistors Q6 and Q7, and a resistor R.

In the reference voltage generating circuit in FIG. 2, the voltage between the gate and source of the NMOS transistor Q7 is designed to be equal to its threshold voltage Vt. In this case, assuming that the current flowing in the resistor R is 0.5 μA, the resistance value R becomes:

$$R=Vt/0.5\ \mu A$$

and, for example, R=1.4 MΩ when Vt=0.7V.

However, in the reference voltage generating circuit in FIG. 2, if a passive resistance device such as an intrinsic poly-silicon layer, $N^+/P^+$ active layer, an $N^-/P^-$ well layer, etc. is used for the resistance R, the reference voltage generating circuit has the same problems as mentioned above.

Although, compared with the reference voltage generating circuit in FIG. 1, the reference voltage generating circuit in FIG. 2 may be less affected by an external bias, the circuit in FIG. 2 needs a separate start-up circuit because its voltage characteristic may be degraded when its power voltage is turned on.

Examples of the reference voltage generating circuits employing passive resistance devices and current mirror circuits can be found in Korean Patent Laid Open 95-20658, Korean Patent Publication 95-10284, and Korean Patent Laid Open 96-35620. An example of the reference voltage generating circuit including a start up circuit is described in U.S. Pat. No. 5,565,811.

SUMMARY OF THE INVENTION

An object of the present invention is to provide a reference voltage generating circuit in which active resistance devices are employed instead of passive resistance devices. Thereby a setting resistance value can be easily obtained, layout area can be minimized, and higher reliability can be secured irrespective of changes in processes.

To accomplish the above and other objects, a reference voltage generating circuit according to a preferred embodiment of the present invention includes an active resistance part having at least one MOS transistor of which gate electrode receives an enable voltage higher than a voltage between drain and source electrodes of the at least one MOS transistor, wherein the at least one MOS transistor is connected between an external voltage and a ground voltage and is operated in a linear region of a current-voltage characteristic curve of the at least MOS transistor. The at least one MOS transistor may be a single MOS transistor or multiple MOS transistors.

In another aspect of the present invention, a reference voltage generating circuit includes a current mirror circuit having first and second current paths formed between a first power source terminal and a second power source terminal in which the current mirror circuit is operated in response to a voltage level of the second current path, a reference voltage output node for providing a reference voltage and being located on the second current path, an active resistance device formed on the first current path to be operated in a linear region of a current-voltage characteristic curve of the active resistance device, and a voltage supply circuit for supplying the active resistance device with an enable voltage to control the active resistance device to be operated in the linear region. The active resistance device may be a single MOS transistor or include multiple MOS transistors.

DETAILED DESCRIPTION OF PREFERRED EMBODIMENTS

Preferred embodiments will be explained in detail with reference to the accompanying drawings. A detailed description below is provided for a full understanding of the present invention. However, one skilled in the art may appreciate that the present invention may be practiced without such particulars. In the following description, a detailed explanation about the devices and functions well known in this art is omitted.

The preferred embodiments of the present invention described herein may be applied to a current mirror type of reference voltage generating circuits. A reference voltage generating circuit according to the first embodiment of the present invention will be explained referring to FIG. 3 and FIG. 4.

Figure 1:
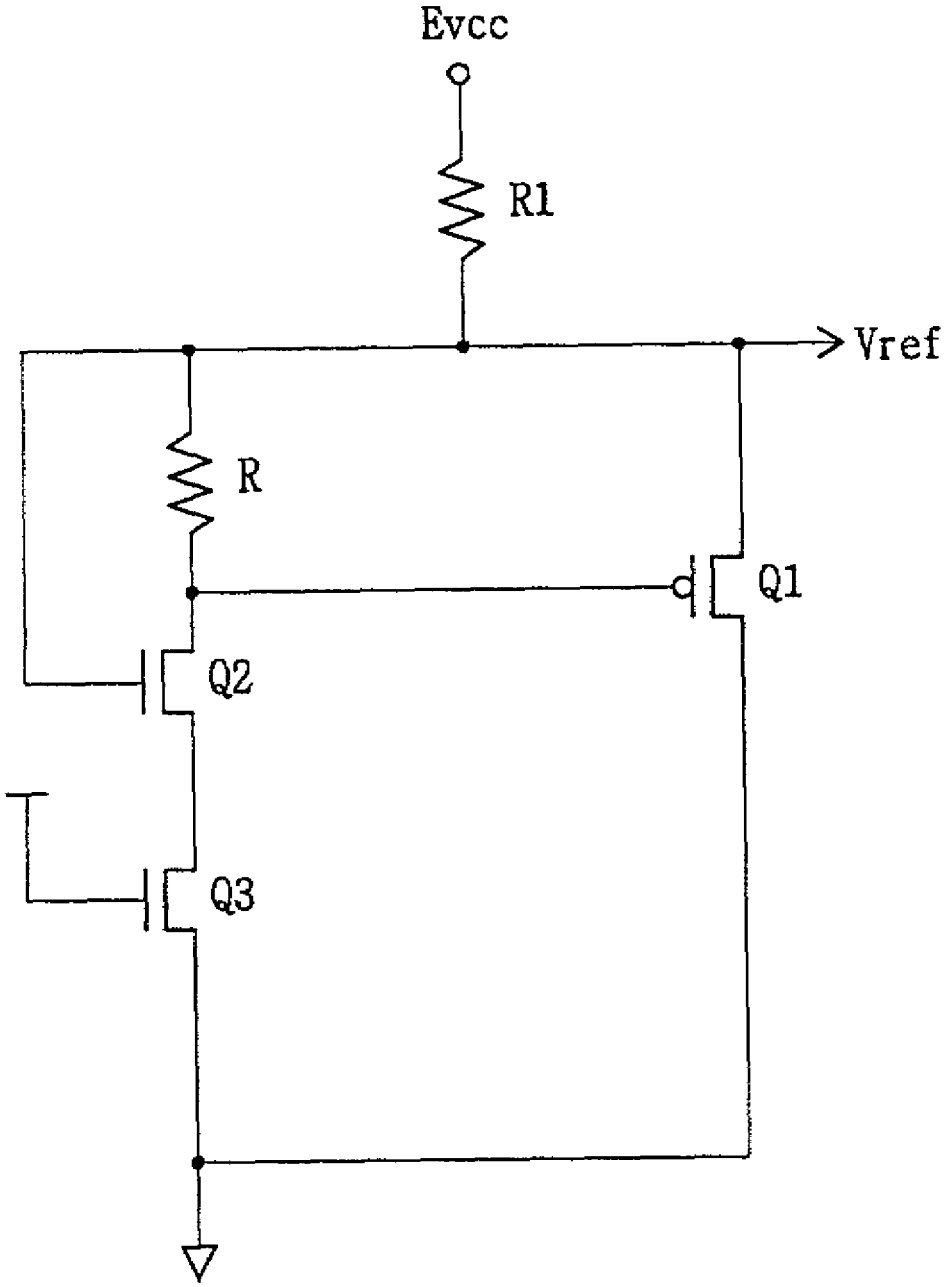
FIG. 1(PRIOR ART)
FIG. 1 is a circuit diagram showing a conventional reference voltage generating circuit having a passive resistance device.
Figure 2:
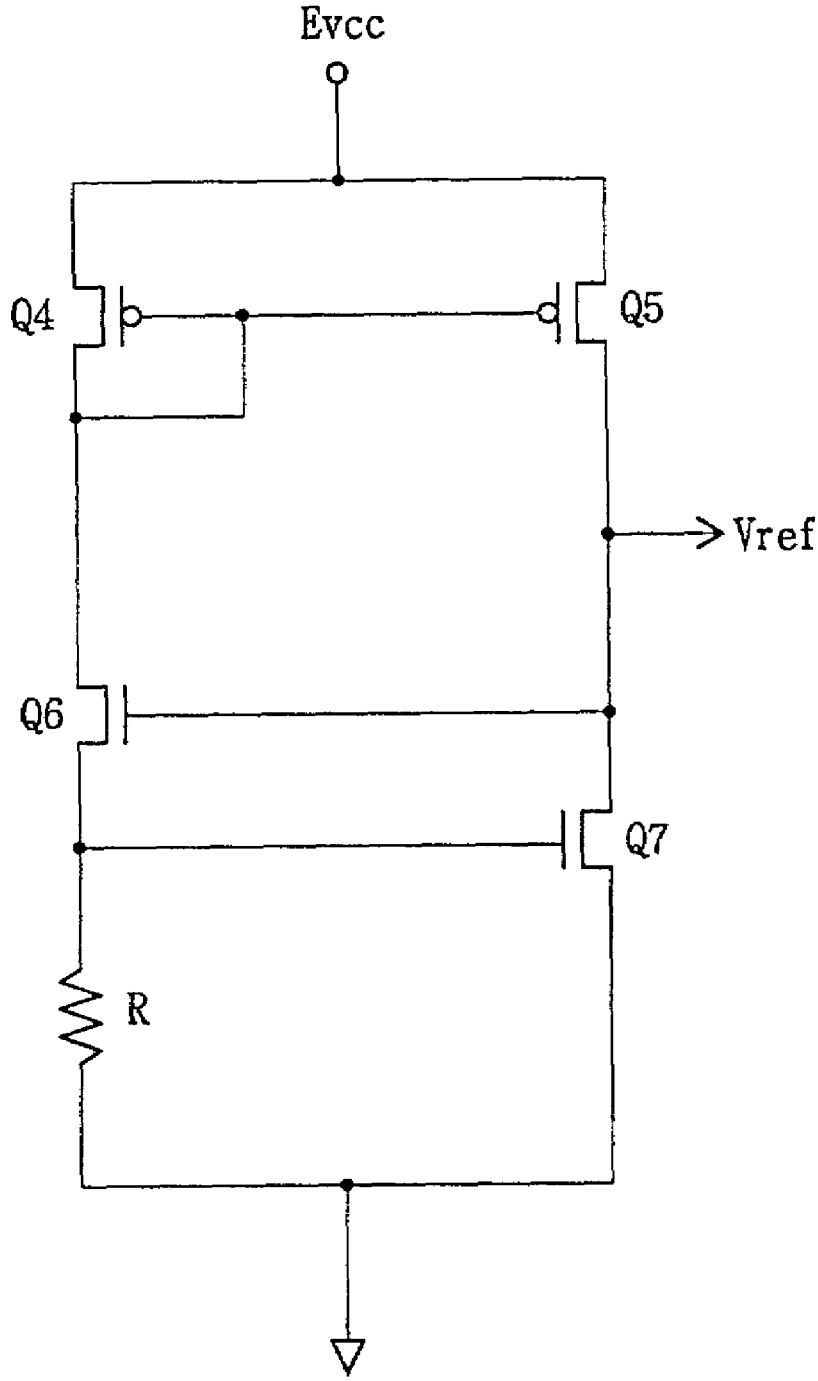
FIG. 2(PRIOR ART)
FIG. 2 is a circuit diagram showing another conventional reference voltage generating circuit having a passive resistance device.
Figure 3:
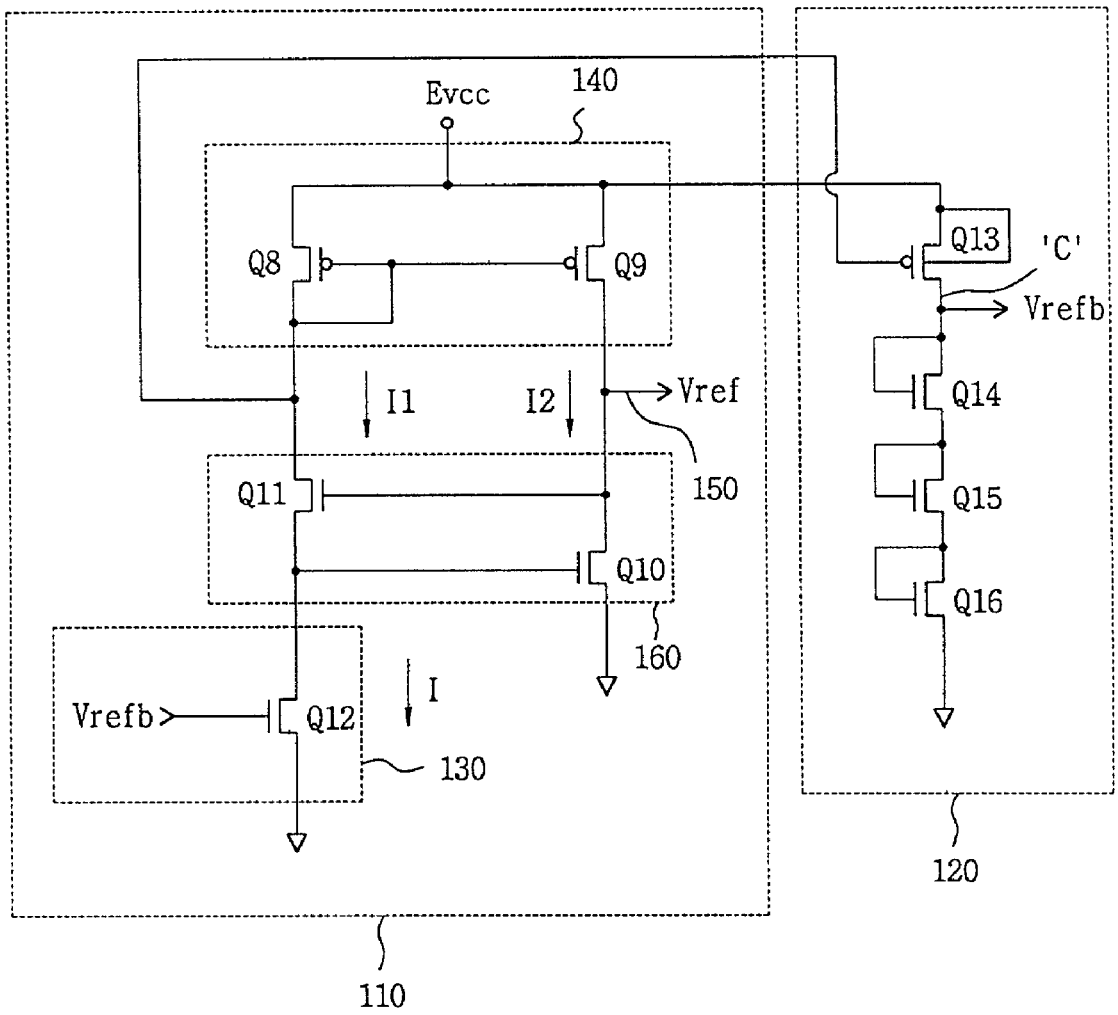
FIG. 3 is a circuit diagram showing a reference voltage generating circuit according to a first embodiment of the present invention.
Figure 4:
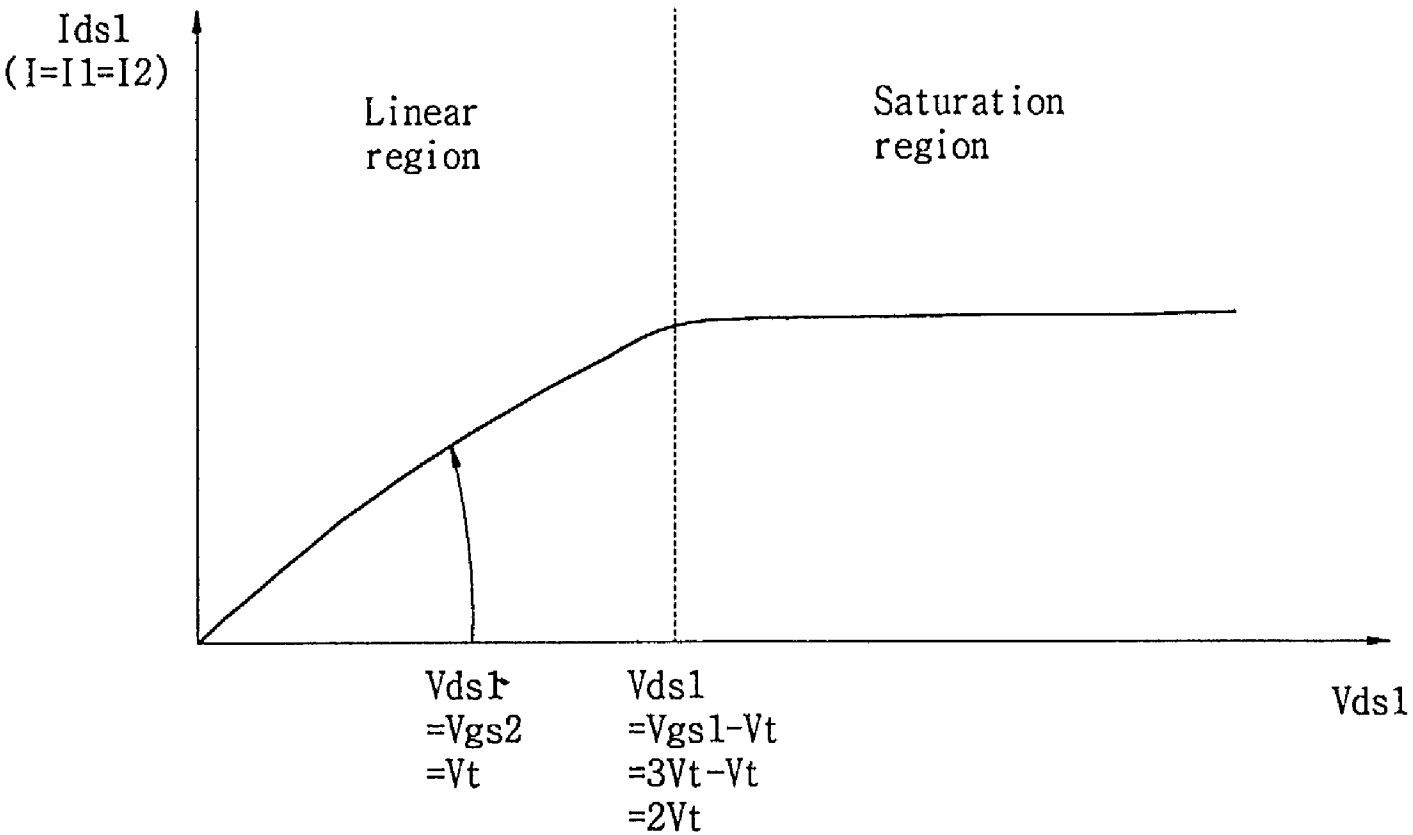
FIG. 4 shows the current-voltage characteristic of an active resistance device in the reference voltage generating circuit in FIG. 3.

FIG. 3 is a circuit diagram illustrating a direct current (DC) threshold voltage type reference voltage generating circuit having a MOS type active resistance device according to the first embodiment of the present invention, and FIG. 4 is a current-voltage characteristic curve of the MOS type active resistance device in FIG. 3.

The reference voltage generating circuit in FIG. 3 includes a reference voltage generating part 110 and a voltage supply circuit 120. The reference voltage generating part 110 includes a current mirror circuit 140, a current control part 160, and an active resistance part 130.

The active resistance part 130 includes an NMOS transistor Q12 used as an active resistance device. The NMOS transistor Q12 has a gate electrode receiving a higher voltage than its drain voltage (i.e., a voltage between drain and source electrodes of the NMOS transistor Q12) and is disposed on a first current path I1 between an external power voltage and a ground voltage. The active resistance device Q12 (e.g., NMOS transistor) is operated in a linear region of its current-voltage characteristic curve.

The voltage supply circuit 120 provides a gate input voltage to the NMOS transistor Q12 used as an active resistance device.

In the reference voltage generating part 110 in FIG. 3, a reference voltage output node 150 is formed on a second current path I2 between the external voltage and the ground voltage to output a reference voltage Vref; the current mirror circuit 140 is connected to the first current path I1 and the second current path I2 to be operated in response to a voltage level of the second current path I2; the active resistance part 130 is formed on the first current path I1 between the external voltage and the ground voltage to be linearly operated by an enable voltage Vrefb, and includes the NMOS transistor Q12 as an active resistance device.

The voltage supply circuit 120 provides the enable voltage Vrefb to the NMOS transistor Q12 used as the active resistance device. The voltage supply circuit 120 includes a PMOS transistor Q13 and a plurality of NMOS transistors Q14–Q16 to supply the enable voltage to the gate of the NMOS transistor which is connected to a contact node between the PMOS transistor Q13 and the NMOS transistor Q14. Here, the enable voltage Vrefb should be higher than a drain voltage of the NMOS transistor Q12 used as the active resistance device. The reason is that the NMOS transistor used as the active resistance device should be operated in the linear region of the current-voltage characteristic curve shown in FIG. 4.

Also, the current control part 160 includes NMOS transistors Q11, Q10 which are respectively formed on the first current path I1 and the second current path I2 to control current flowing in the first and second current paths. The current mirror circuit 140 includes, for example, a pair of PMOS transistors Q8, Q9.

A detailed description of the structure of the reference voltage generating circuit in FIG. 3 follows.

In the current mirror circuit 140, the external voltage EVcc is applied to the sources of the PMOS transistors Q8 and Q9. The gate of the PMOS transistor Q9 is connected to the gate and drain of the PMOS transistor Q8. The drain of the PMOS transistor Q8 is connected to the drain of the NMOS transistor Q11. The drain of the PMOS transistor Q9 is connected to the gate of the NMOS transistor Q11 and the drain of the NMOS transistor Q10. The source of the NMOS transistor Q10 is connected to the ground. The reference voltage output node 150 is formed between the drain of the PMOS transistor Q9 and the drain of the NMOS transistor Q10.

In the active resistance part 130, the drain of the NMOS transistor Q12, which is used as an active resistance device, is connected to the gate of the NMOS transistor Q10 and the source of the NMOS transistor Q11. The source of the NMOS transistor Q12 is connected to the ground. The gate of the NMOS transistor Q12 receives from the power supply circuit 120 the enable voltage Vrefb which is higher than the drain voltage of the NMOS transistor Q12, so that the NMOS transistor Q12 is operated in the linear region.

In the voltage supply circuit 120, the drain voltage of the PMOS transistor Q8 in the current mirror circuit 140 is provided to the gate of the PMOS transistor Q13. And, the external voltage (EVcc) is provided to the source of the PMOS transistor Q13. The source of the PMOS transistor Q13 is connected to a back gate of the PMOS transistor Q13. The drain of the PMOS transistor Q13 is connected to a set of NMOS transistors, for example, three NMOS transistors Q14–Q16. In particular, the drain of the PMOS transistor Q13 is connected to the drain and gate of the NMOS transistor Q14, the drain and gate of the NMOS transistor Q15 are connected to the source of the NMOS transistor Q14, the drain and gate of the NMOS transistor Q16 are connected to the source of the NMOS transistor Q15, and the source of the NMOS transistor Q16 is connected to the ground voltage.

The gate of the NMOS transistor Q12 is connected to the drain of the PMOS transistor Q13 and the drain of the NMOS transistor Q14. Two current paths I1, I2 are formed between the external voltage EVcc and the ground voltage, as shown in FIG. 3.

Now, a detailed description of the operation of the reference voltage generating circuit in FIG. 3 follows.

First, the operation of the reference voltage generating part 110 will be explained. The transistors Q8 and Q9 of the current mirror circuit 140 are operated in a saturation region of the current-voltage characteristic curve in FIG. 4. The NMOS transistors Q10 and Q11 used to control current flowing in the first current path I1 and second current path I2 are also operated in the saturation region. Since the PMOS transistors Q8 and Q9 serve as a current mirror, the current flowing in the first current path I1 and the current flowing in the second current path I2 are equal to each other. If the current flowing in either the first or second current path I1 or I2 is denoted as "I", a voltage applied to the gate of the NMOS transistor Q10 becomes:

$$I \times Req$$

where "Req" is an effective resistance of the NMOS transistor Q12.

Therefore, the reference voltage generating part 110 at an operating point satisfies the following mathematical formula 1.

$$I \cdot Req = Vgs1 = Vt + [2I/_n C_{OX}(W_2/L_2)]^{1/2} \quad \text{[formula 1]}$$

where "Vt" is a threshold voltage of the MOS transistor Q10.

In the formula 1, if the value $W_2/L_2$ of the NMOS transistor Q10 increases, the formula 1 can be converted into the following simple formula 2.

$$I \cdot Req = Vgs1 = Vt \quad \text{[formula 2]}$$

When the NMOS transistor Q12 used as an active resistance device is operated in the linear region, the relationship between current flowing in and voltage applied to the NMOS transistor Q12 is linearized. Therefore, the resistance has the same current-voltage characteristic as shown in FIG. 4.

At the boundary region between the linear region and the saturation region of the NMOS transistor Q12, the following relationship is satisfied:

$$Vds1 = Vgs1 - Vt = 3Vt - Vt$$

Therefore, the gate voltage Vgs1 of the transistor Q12 should be higher than 2Vt in order for the transistor Q12 of the active resistance device to be operated in the linear region, as shown in FIG. 4.

Next, the operational characteristic of the voltage supply circuit 120 for supplying a gate voltage of the NMOS transistor Q12 of the active resistance device will be described. The gate voltage of the PMOS transistor Q13 is the same as the gate and drain voltage of the PMOS transistor Q8, and the voltage value is equal to "EVcc−Vthp" (here, Vthp is a threshold voltage of the PMOS transistor Q13). Therefore, the voltage Vgs13 between the gate and source of the PMOS transistor Q13 is kept constant. The drain of the PMOS transistor Q13 is connected to the drain of the NMOS transistor Q14.

In the voltage supply circuit 120, the voltage at node C is equal to a sum of the threshold voltages of the MOS transistors (or diodes) Q14, Q15, Q16. Assuming that an increase in the threshold voltages of the transistors Q14–Q16 caused by their body effect may be ignored, the voltage at the node C (i.e., the enable voltage Vrefb) becomes "3Vt" when each of the threshold voltages of the transistors Q14–Q16 is "Vt". Here, the number of the NMOS transistors (or diodes) that are connected in series to the drain of the PMOS transistor Q13 is not fixed but variable. For instance, if the number of the NMOS transistors serially connected to the PMOS transistor Q13 is four (4), the voltage at the node C becomes "4Vt".

The voltage at the node C is provided as the enable voltage Vrefb to the gate of the NMOS transistor Q12 that serves as an active resistance device of the reference voltage generating circuit. In case that the number of the NMOS transistors in the voltage supply circuit 120 are three (3), the gate voltage of the NMOS transistor Q12 is "3Vt", and the voltage between the drain and source of the NMOS transistor Q12 is "Vt". Therefore, the NMOS transistor Q12 is operated at the linear region and has the same current-voltage characteristic as that of a passive resistance device.

Next, the reference voltage generating circuit according to the second embodiment of the present invention will be explained with reference to FIGS. 5 and 6.

Figure 5:
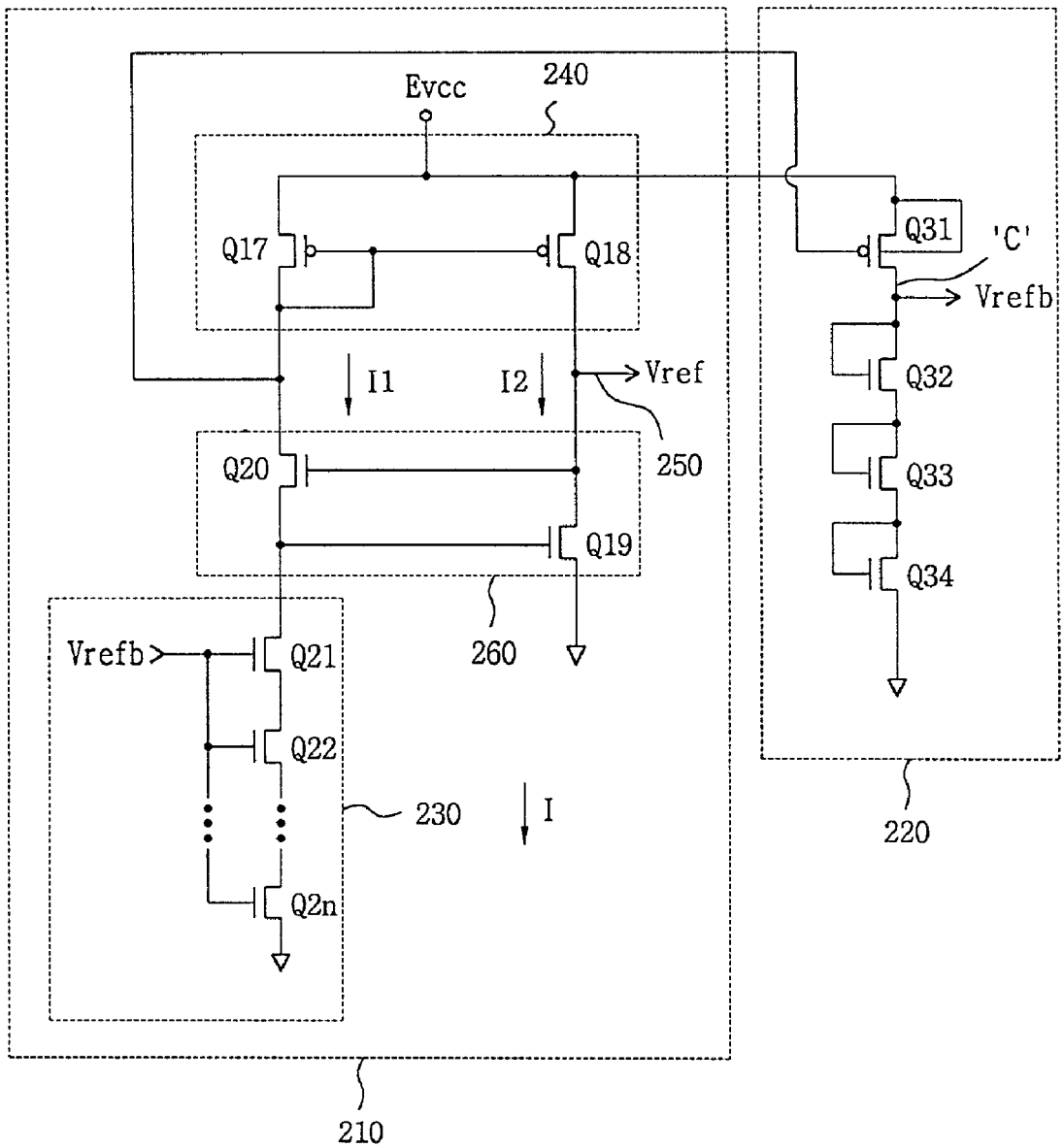
FIG. 5 is a circuit diagram showing a reference voltage generating circuit according to a second embodiment of the present invention.

Referring to FIG. 5, a reference voltage generating circuit according to the second embodiment of the present invention includes multiple active resistance devices. There may be a difficulty in obtaining a suitable resistance value in the reference voltage generating circuit having one active resistance device as shown in FIG. 3. In this case, the reference voltage generating circuit may employ multiple active resistance devices as shown in FIG. 5. As an example, the reference voltage generating circuit in FIG. 5 has "n" NMOS transistors Q21–Q2*n* as the multiple active resistance devices, which are connected in series between a current control part 260 and the ground, and of which gates are commonly connected to the node C in a voltage supply circuit 220 to receive an enable voltage Vrefb.

A detailed description of the parts in FIG. 5 equivalent to those in FIG. 3 will be omitted to avoid duplication. For example, the voltage supply circuit 220, the current mirror circuit 240, and the current control part 260 in FIG. 5 may be functionally and/or structurally equivalent to those (i.e., 120, 140 and 160) in FIG. 3, respectively.

In the reference voltage generating circuit in FIG. 5, if a set of the NMOS transistors Q21–Q2*n* is denoted as "Q1_effective", the boundary voltage between the linear region and the saturation region of the set of the NMOS transistors (Q1_effective) becomes:

$$Vgs1_effective - Vth1_effective.$$

In this case, the boundary voltage of the active resistance part 230 in FIG. 5 is higher than that of the active resistance part 130 in FIG. 3. Thus, the reference voltage generating circuit in FIG. 5 may have more secured operation in the linear region.

Figure 6:
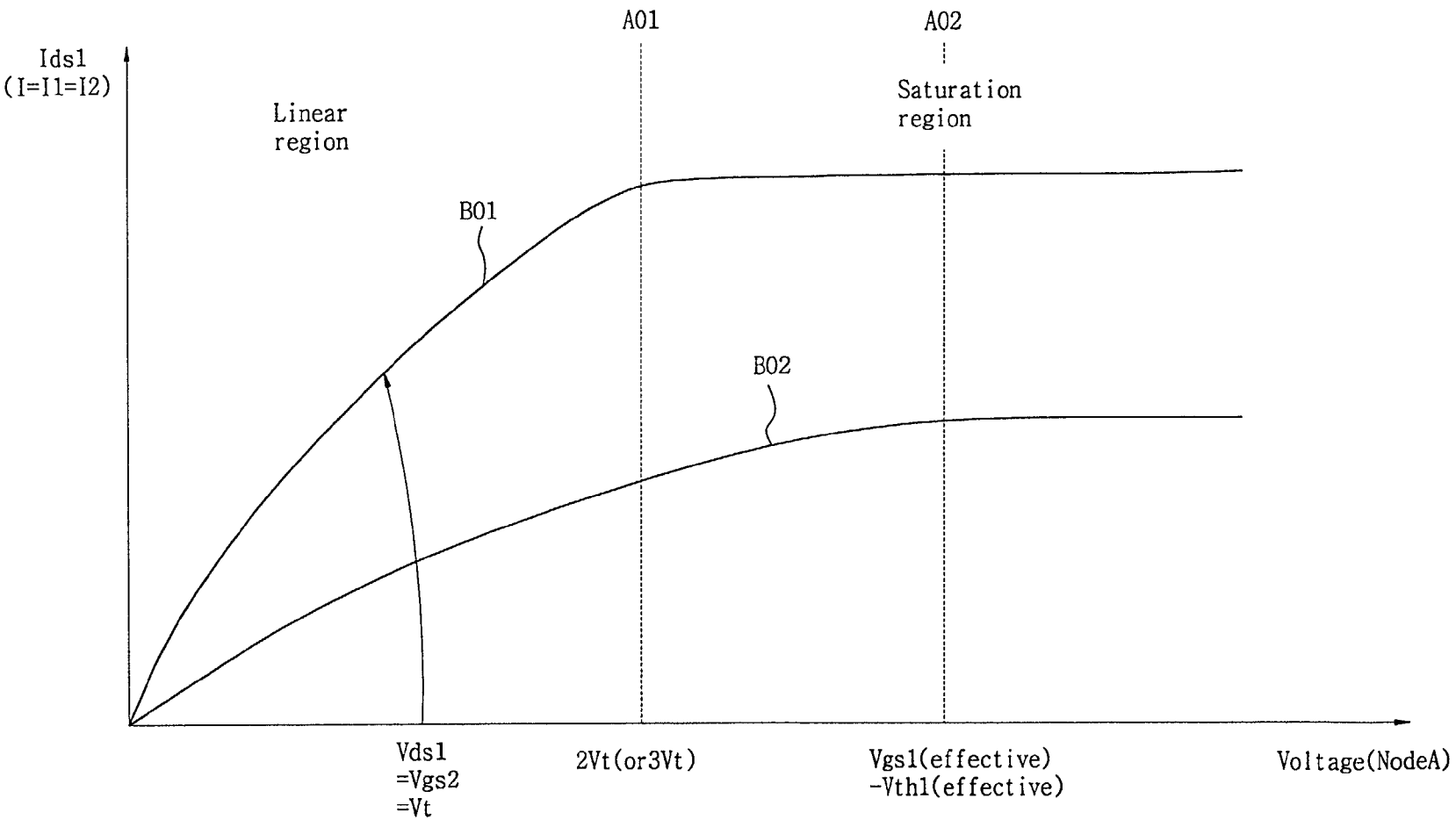
FIG. 6 shows the current-voltage characteristic of an active resistance in the reference voltage generating circuit in FIG. 5.

Referring to FIG. 6, the current-voltage characteristic curve shows that the active resistance part 230 with multiple active resistance devices has larger linear region (A02) than that (A01) of the active resistance part 130 with one active resistance device. In other words, the active resistance devices (e.g., NMOS transistors) of the reference voltage generating circuit in FIG. 5 may perform stable operation at the linear region.

As described above, the reference voltage generating circuit according to the present invention employs active resistance devices in lieu of passive resistance devices used in the conventional circuits, so that the current consumption in the reference voltage generating circuit can be reduced.

Although having described the preferred embodiments of the present invention, modifications and variations may be readily made by those skilled in the art in the light of the teachings of the present invention. Accordingly, the scope of the present invention should not be limited to the explained embodiments but determined by the following claims.

What is claimed is:

1. A reference voltage generating circuit comprising an active resistance part having a plurality of MOS transistors connected between an external voltage and a ground voltage, each of the plurality of MOS transistors having a gate electrode which receives an enable voltage at a potential higher than a voltage potential between drain and source electrodes of each of the plurality of MOS transistors to operate in a linear current-voltage region, a current mirror circuit comprising first and second PMOS transistors, a source of each of the first and second PMOS transistors receiving the external voltage, wherein the current mirror circuit is electrically connected to the active resistance part, and a voltage supply circuit comprising a third PMOS transistor and a plurality of NMOS transistors, wherein the voltage supply circuit supplies the enable voltage to the plurality of MOS transistors, wherein the enable voltage is determined by the NMOS transistors, wherein a gate of the third PMOS transistor is connected to a drain of the first PMOS transistor, a source of the third PMOS transistor receives the external voltage and is connected to a back gate of the third PMOS transistor, and a drain of the third PMOS transistor is connected to a drain and a gate of a first NMOS transistor of the plurality of NMOS transistors.

2. The circuit as claimed in claim 1, wherein gate electrodes of each of the plurality of MOS transistors of the active resistance part are connected to a common node for receiving the enable voltage.

3. The circuit as claimed in claim 1, wherein the plurality of MOS transistors are connected in series between the external voltage and the ground voltage.

4. A reference voltage generating circuit comprising:

a current mirror circuit having first and second current paths formed between a first power source terminal and a second power source terminal, the current mirror circuit being operated in response to a voltage level of the second current path;

a reference voltage output node for providing a reference voltage, the reference voltage output node being located on the second current path;

an active resistance device formed on the first current path to be operated in a linear region of a current-voltage characteristic curve of the active resistance device; and a voltage supply circuit for supplying the active resistance device with an enable voltage to control the active resistance device to be operated in the linear region, wherein the voltage supply circuit includes a PMOS transistor and a plurality of NMOS transistors, wherein the enable voltage is determined by the NMOS transistors and obtained at a node between the PMOS transistor and the plurality of NMOS transistors, wherein a gate of the PMOS transistor is connected to a drain of a first PMOS transistor formed on the first current path, a source of the PMOS transistor receives an externally applied voltage and is connected to a back gate of the PMOS transistor, and a drain of the PMOS transistor is connected to a drain and a gate of a first NMOS transistor of the plurality of NMOS transistors.

5. The circuit as claimed in claim 4, wherein the active resistance device is a single MOS transistor having a gate electrode for receiving the enable voltage from the voltage supply circuit.

6. The circuit as claimed in claim 5, wherein the enable voltage is higher than a voltage between drain and source electrodes of the MOS transistor.

7. The circuit as claimed in claim 4, wherein the active resistance device includes a plurality of MOS transistors arranged in series on the first current path, gate electrodes of the plurality of MOS transistors receive the enable voltage from the voltage supply circuit.

8. The circuit as claimed in claim 7, wherein the enable voltage is higher than a sum of voltages, wherein each voltage is obtained between drain and source electrodes of a corresponding one of the plurality of MOS transistors.

9. The circuit as claimed in claim 4, wherein the first power source terminal receives the externally applied voltage and the second power source terminal is connected to a ground voltage.

10. The circuit as claimed in claim 4, further including a current control unit for controlling current flowing in the first and second current paths by employing MOS transistors formed on the first and second current paths, respectively.

11. The circuit as claimed in claim 4, wherein the current mirror circuit includes the first PMOS transistor formed on the first current path and a second PMOS transistor formed on the second current path.

12. A reference voltage generating circuit comprising:

a current mirror circuit having first and second MOS transistors, sources of the first and second MOS transistors receiving an externally applied voltage, a gate of the first MOS transistor being connected to a gate of the second MOS transistor and to a drain of the first MOS transistor;

a current control circuit having third and fourth MOS transistors, a drain of the third MOS transistor being connected to the drain of the first MOS transistor, a drain of the fourth MOS transistor being connected to a gate of the third MOS transistor and a drain of the second MOS transistor, a source of the fourth MOS transistor being connected to a ground, and a reference voltage being provided on a node between the drain of the second MOS transistor and the drain of the fourth MOS transistor;

an active resistance circuit having a fifth MOS transistor, a drain of the fifth MOS transistor being connected to a gate of the fourth MOS transistor and a source of the third MOS transistor, a source of the fifth MOS transistor being connected to the ground, and a gate of the fifth MOS transistor receives a control voltage higher than a voltage between the drain and source of the fifth MOS transistor so that the fifth MOS transistor is operated in a linear region; and a voltage supply circuit having a PMOS transistor and a set of NMOS transistors, wherein the voltage supply circuit supplies an enable voltage to the fifth MOS transistor, wherein the enable voltage as the control voltage is determined by the set of NMOS transistors, wherein a gate of the PMOS transistor is connected to the drain of the first MOS transistor, a source of the PMOS transistor receives the externally applied voltage and is connected to a back gate of the PMOS transistor, a drain of the PMOS transistor is connected to a drain and gate of a first NMOS transistor of the set of NMOS transistors which are connected in series between the PMOS transistor and the ground, and the control voltage is provided from a node between the PMOS transistor and the first NMOS transistor of the set of NMOS transistors to the gate of the fifth MOS transistor.

13. The circuit as claimed in claim 12, wherein the active resistance circuit further includes sixth through $n_{th}$ MOS transistors, the fifth through $n_{th}$ MOS transistors being connected in series between the current control circuit and the ground, and gates of the respective fifth through $n_{th}$ MOS transistors receiving the control voltage from the voltage supply circuit.

* * * * *